US012709359B2

(12) United States Patent
Iwata

(10) Patent No.: US 12,709,359 B2
(45) Date of Patent: Aug. 18, 2026

(54) PERSONAL WATERCRAFT

(71) Applicant: KAWASAKI MOTORS, LTD., Hyogo (JP)

(72) Inventor: Tetsuya Iwata, Akashi (JP)

(73) Assignee: KAWASAKI MOTORS, LTD., Akashi (JP)

( * ) Notice: Subject to any disclaimer, the term of this patent is extended or adjusted under 35 U.S.C. 154(b) by 478 days.

(21) Appl. No.: 18/212,185

(22) Filed: Jun. 21, 2023

(65) Prior Publication Data

US 2024/0425151 A1 Dec. 26, 2024

(51) Int. Cl.

| | |
|---|---|
| ***B63B 34/10*** | (2020.01) |
| ***B63B 43/04*** | (2006.01) |
| ***B63B 43/14*** | (2006.01) |

(52) U.S. Cl.

CPC ..... *B63B 34/10* (2020.02); *B63B 43/04* (2013.01); *B63B 43/14* (2013.01); *B63B 2231/44* (2013.01)

(58) Field of Classification Search

CPC ..... B63B 34/00; B63B 34/21; B63B 34/23; B63B 34/70; B63B 43/00; B63B 43/04; B63B 43/14; B63B 2231/00; B63B 2231/40; B63B 2231/42; B63B 2231/44; B63B 2231/46; B63B 2231/48; B63B 2231/50; B63B 2231/52

USPC ..... 114/55.5, 55.54, 55.55, 55.57, 271, 283, 114/292, 360, 364

See application file for complete search history.

(56) References Cited

U.S. PATENT DOCUMENTS

| | | | | |
|---|---|---|---|---|
| 5,699,749 | A * | 12/1997 | Yamada | B63B 1/042 114/283 |
| 6,048,236 | A * | 4/2000 | Natsume | B63H 20/34 123/195 P |
| 6,273,015 | B1 * | 8/2001 | Motsenbocker | B63B 1/14 114/61.12 |
| 6,422,168 | B1 * | 7/2002 | Kobayashi | B63B 1/20 114/291 |
| 6,486,288 | B1 * | 11/2002 | Ziche | C08K 5/0091 528/34 |
| 6,523,490 | B1 * | 2/2003 | Watkins | B63B 39/06 114/55.54 |
| 6,651,579 | B1 * | 11/2003 | Wynne | B63B 34/10 114/55.54 |
| 6,712,016 | B1 * | 3/2004 | Morisch | B63B 1/18 114/284 |
| 6,807,920 | B1 * | 10/2004 | Wynne | B63B 41/00 114/284 |
| 7,426,896 | B2 * | 9/2008 | West | B63B 34/10 114/55.58 |
| 7,958,838 | B1 * | 6/2011 | Larose | B63B 59/02 114/355 |
| 2013/0102206 | A1 | 4/2013 | Fujino et al. | |

* cited by examiner

*Primary Examiner* — Daniel V Venne
(74) *Attorney, Agent, or Firm* — XSENSUS LLP

(57) ABSTRACT

A personal watercraft includes: a watercraft body; a handlebar provided on an upper front part of the watercraft body; a seat provided on an upper part of the watercraft body and extending in a front-rear direction behind the handlebar; and a pair of floats provided so as to protrude outward in a watercraft width direction from left and right side surfaces of the watercraft body in order to additionally give buoyancy to the watercraft body. Each of the floats extends in the front-rear direction alongside the seat and is arranged limitedly in a region behind the handlebar.

18 Claims, 9 Drawing Sheets

PERSONAL WATERCRAFT

BACKGROUND

Technical Field

The present disclosure relates to a personal watercraft that planes on water.

Background Art

A personal watercraft described in US 2013/0102206 A1 is known as a type of personal watercraft. In order to make it easy to handle the personal watercraft, it is desirable to improve attitude stability. However, if the attitude stability is emphasized too much, the planing performance of the personal watercraft may be impaired.

SUMMARY

The present disclosure has been made in view of the above circumstance, and an object of the present disclosure is to provide a personal watercraft capable of improving attitude stability while ensuring planing performance.

In order to solve the above problem, a personal watercraft according to one aspect of the present disclosure includes: a watercraft body; a handlebar provided on an upper front part of the watercraft body; a seat provided on an upper part of the watercraft body and extending in a front-rear direction behind the handlebar; and a pair of floats provided so as to protrude outward in a watercraft width direction from left and right side surfaces of the watercraft body in order to additionally give buoyancy to the watercraft body, in which each of the floats extends in the front-rear direction alongside the seat and is arranged limitedly in a region behind the handlebar.

DETAILED DESCRIPTION

Hereinafter, an embodiment of a personal watercraft of the present disclosure will be described with reference to the drawings. Some of the drawings are given indications of front, rear, left, and right directions, and these directions coincide with directions viewed from the driver on the personal watercraft.

[Overall Configuration of Personal Watercraft]

Figure 1:
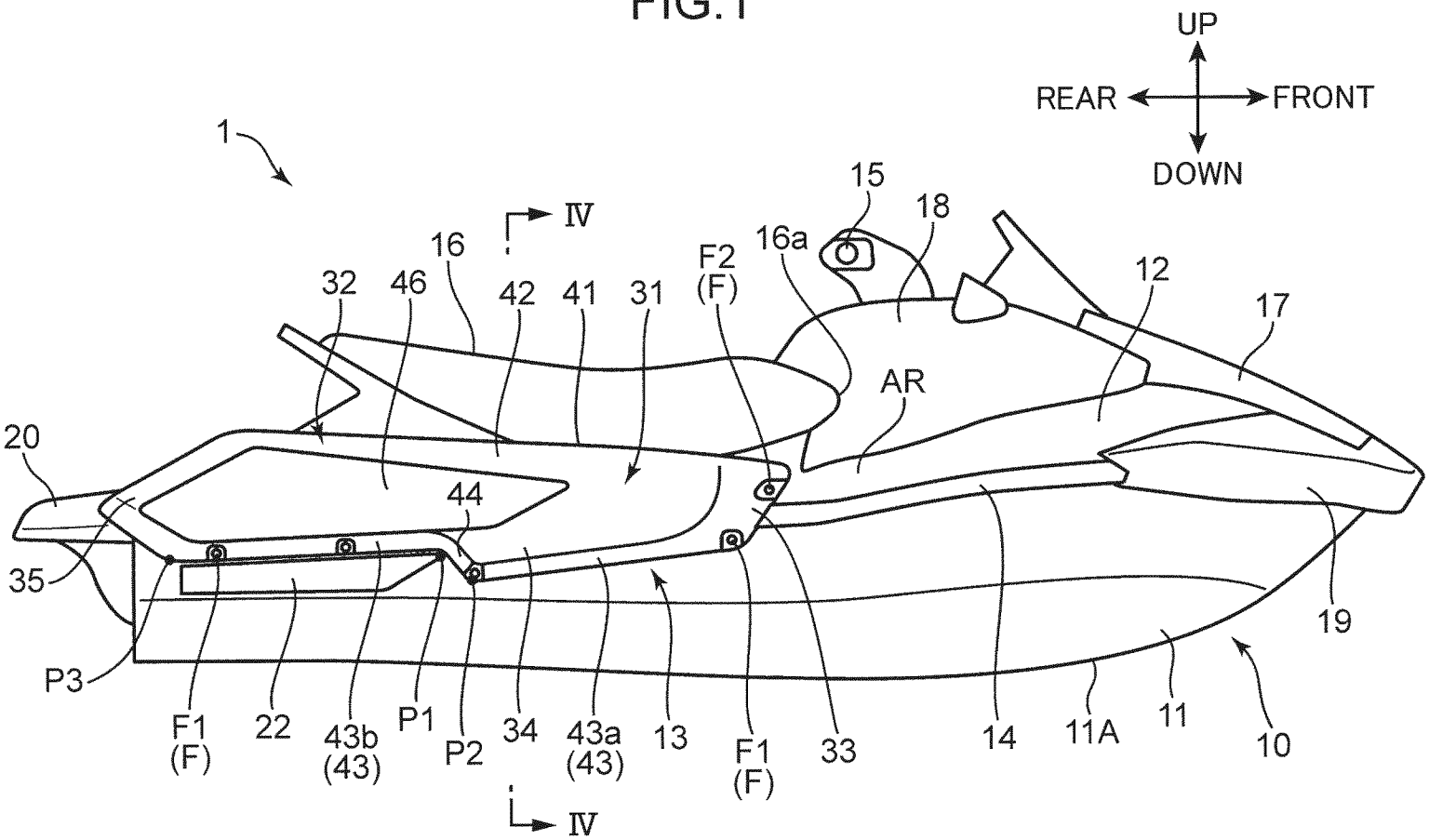
FIG. 1 is a side view of a personal watercraft according to an embodiment of the present disclosure.
Figure 2:
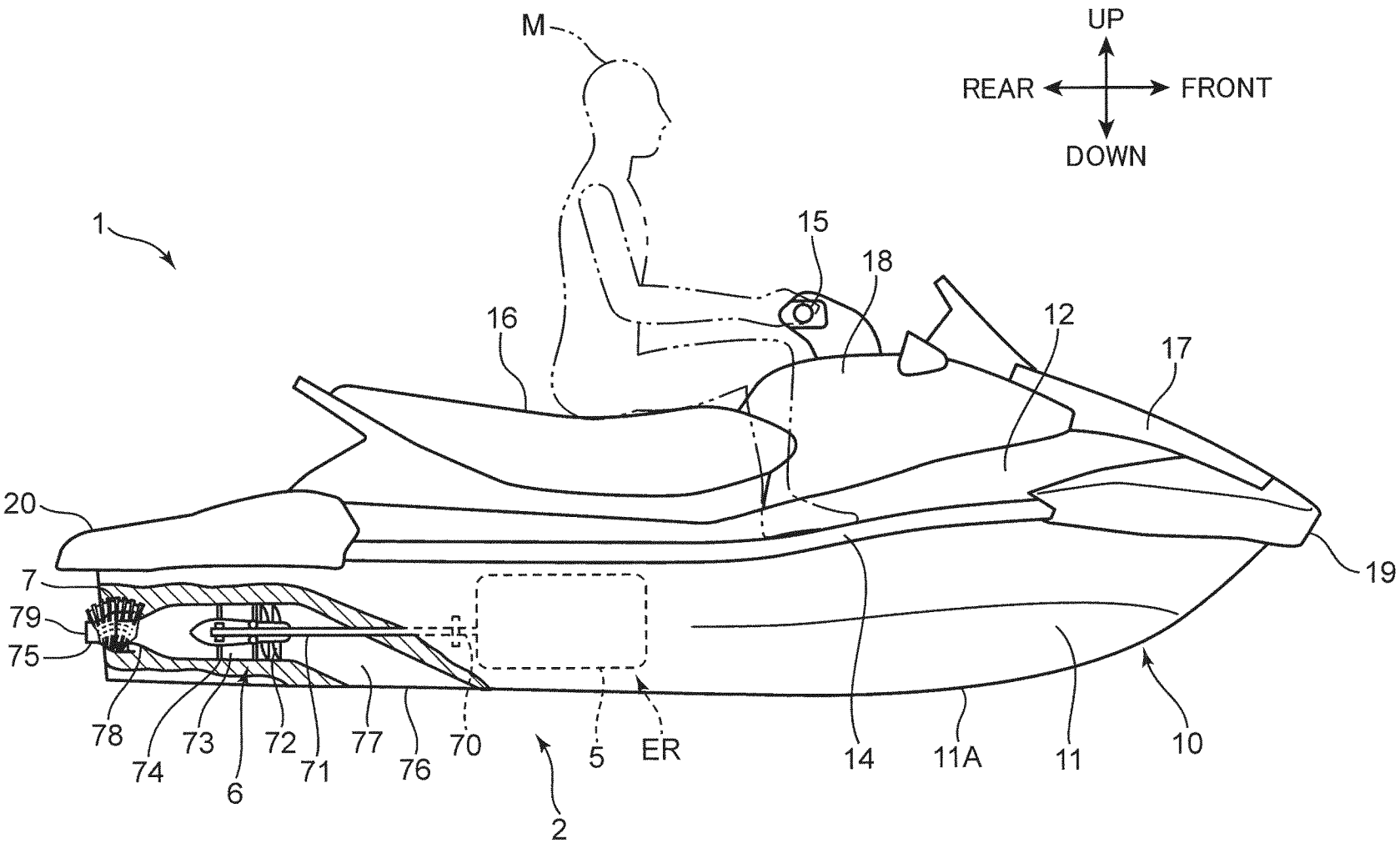
FIG. 2 is a partially broken side view of the personal watercraft.
Figure 3:
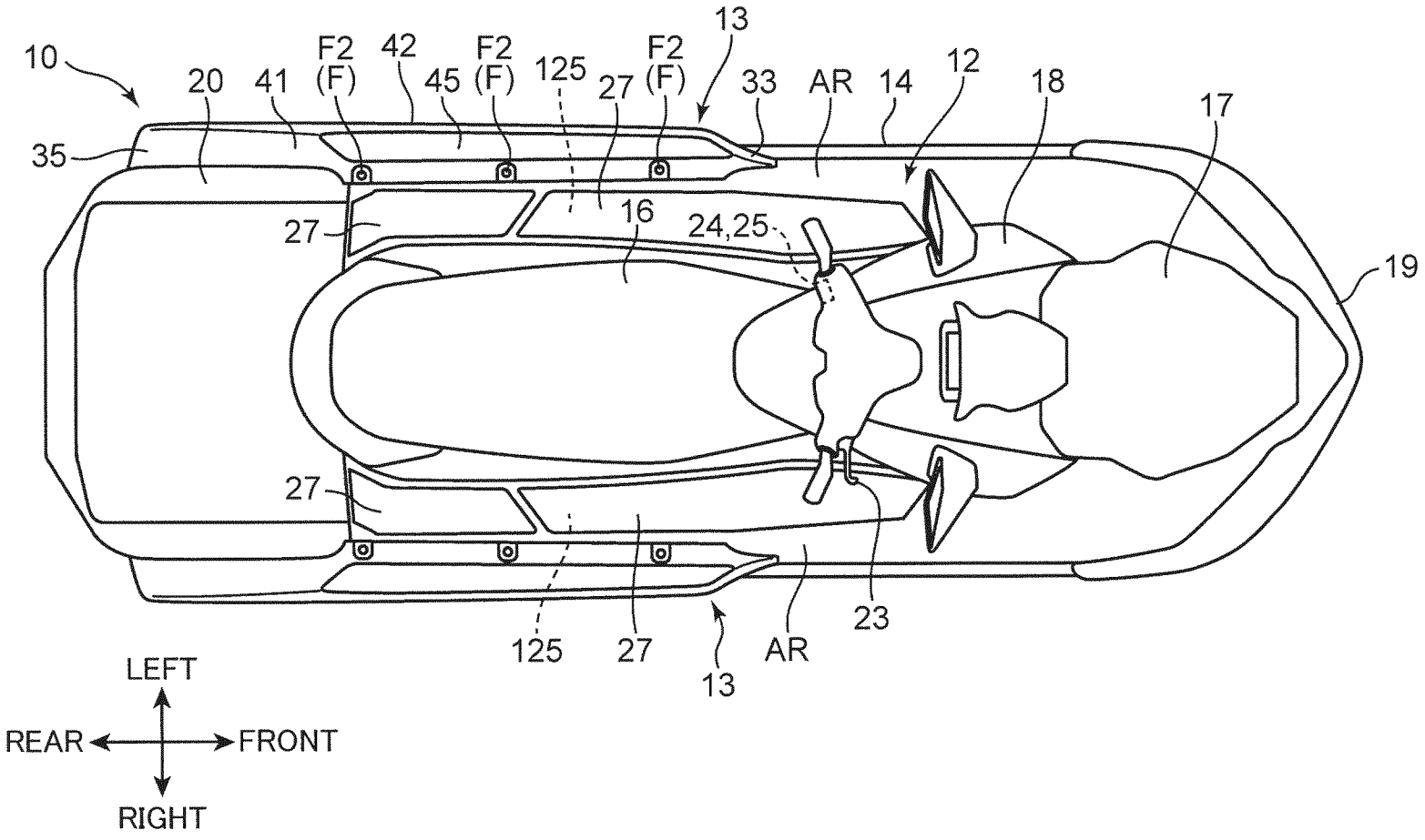
FIG. 3 is a plan view of the personal watercraft.

FIG. 1 is a side view of a personal watercraft 1 according to an embodiment of the present disclosure. FIG. 2 is a partially broken side view of the personal watercraft 1. FIG. 3 is a plan view of the personal watercraft 1. FIG. 2 also illustrates a driver M aboard the personal watercraft 1. The personal watercraft 1 is a straddle-type watercraft called PWC, which jets a water flow rearward and moves on the water as a reaction. The personal watercraft 1 (hereinafter, abbreviated as PWC 1) includes a watercraft body 10 and a propulsion device 2 (FIG. 2) that gives a propulsion force to the watercraft body 10 by jetting of a jet water flow.

Figure 4:
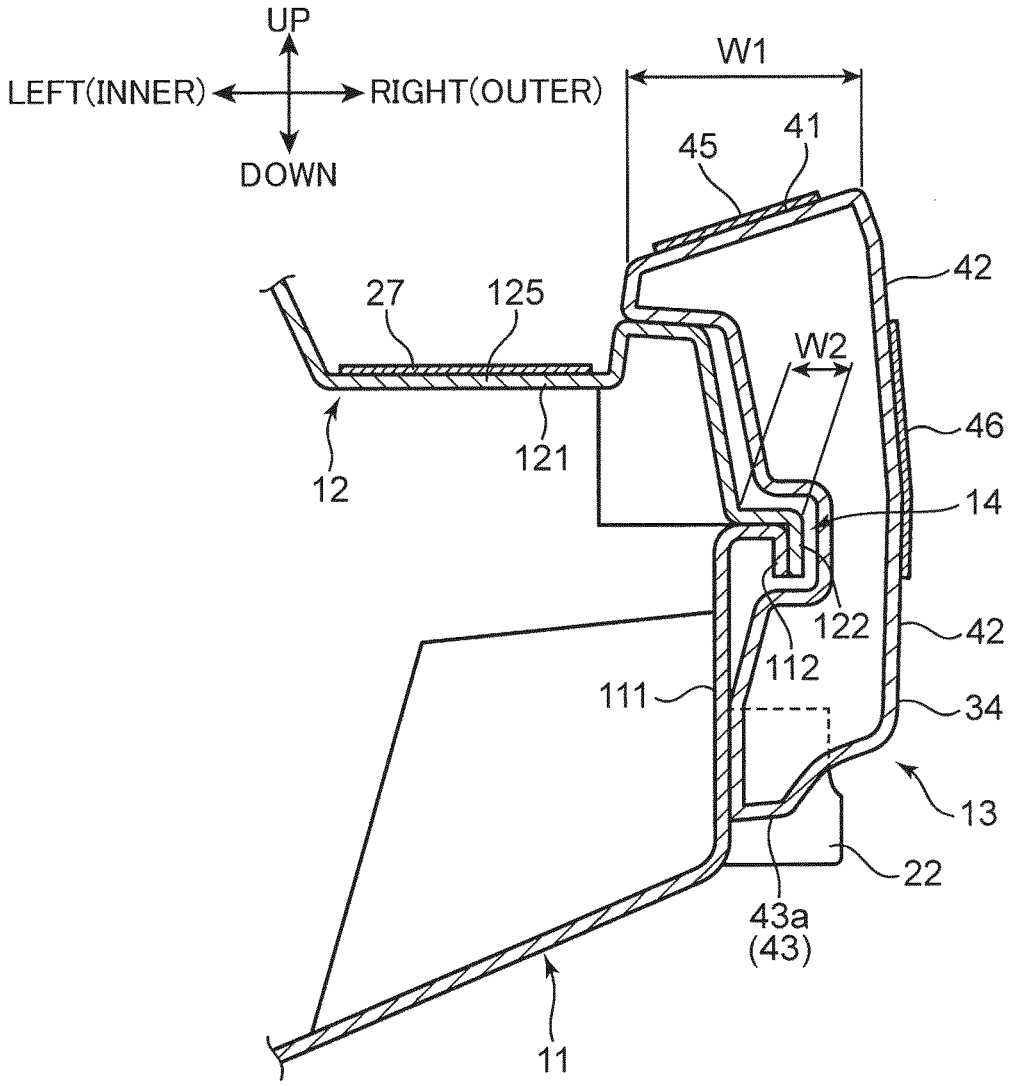
FIG. 4 is an enlarged cross-sectional view of a right side part of a watercraft body.

FIG. 4 is an enlarged cross-sectional view of the right side part of the watercraft body 10, and is a cross-sectional view taken along line IV-IV in FIG. 1. As illustrated in FIGS. 1 to 4, the watercraft body 10 includes a hull 11, a deck 12, and a pair of left and right floats 13. The hull 11 is a component constituting a bottom of the watercraft body 10, and has a substantially bowl-like shape with an open upper surface in cross-sectional view. The deck 12 is a component covering the upper surface opening of the hull 11, and is joined to an opening edge (upper edge) of the hull 11 over the entire periphery. The pair of floats 13 are a resin hollow component for additionally giving buoyancy to the watercraft body 10, and is provided so as to protrude outward in the watercraft width direction from the left and right side surfaces of the watercraft body 10. The watercraft width direction is a direction orthogonal to the front-rear direction of the watercraft body 10 in plan view. In FIG. 2, the float 13 is not illustrated.

A gunwale 14 is formed on a peripheral surface of the watercraft body 10. The gunwale 14 is a joint portion between the hull 11 and the deck 12. That is, as illustrated in FIG. 4, the hull 11 has a hull body 111 having a substantially bowl-like shape in cross-sectional view, and a flange portion 112 protruding in the outboard direction (outside in the watercraft width direction in FIG. 4) from an opening edge of an upper end of the hull body 111. The deck 12 includes a deck body 121 covering the hull body 111 from above, and a flange portion 122 protruding in the outboard direction from an opening edge of a lower end of the deck body 121. Then, by joining the flange portion 112 of the hull 11 and the flange portion 122 of the deck 12 to each other, the deck 12 and the hull 11 are integrated in a state where the deck 12 covers the hull 11, and the gunwale 14 consisting of a joint portion between the flange portions 112 and 122 is formed. The gunwale 14 is formed so as to surround the entire periphery of the watercraft body 10 and protrude outward from the peripheral surface of the watercraft body 10.

As illustrated in FIGS. 1 to 3, the deck 12 is provided with a front hatch 17, a front cover 18, a front bumper 19, and a rear cover 20. The front hatch 17 is a lid covering an upper surface opening of a stowage space formed in a front part of the deck 12. The front cover 18 is a cover covering an upper part of the deck 12 behind the front hatch 17. The front bumper 19 is a component covering the gunwale 14 at the frontmost part of the watercraft body 10. The rear cover 20 is a plate-like cover provided behind a seat 16 described later, and covering a rear part of the hull 11.

A rear part of the watercraft body 10 is provided with a pair of left and right stabilizers 22 (sponsons). The pair of stabilizers 22 are plate-shaped projections protruding outward in the watercraft width direction from the left and right side surfaces, respectively, of the rear part of the hull 11. As illustrated in FIG. 1, the stabilizer 22 is arranged below the float 13. The pair of floats are separated from the pair of stabilizers in an up-down-direction.

Figure 5A:
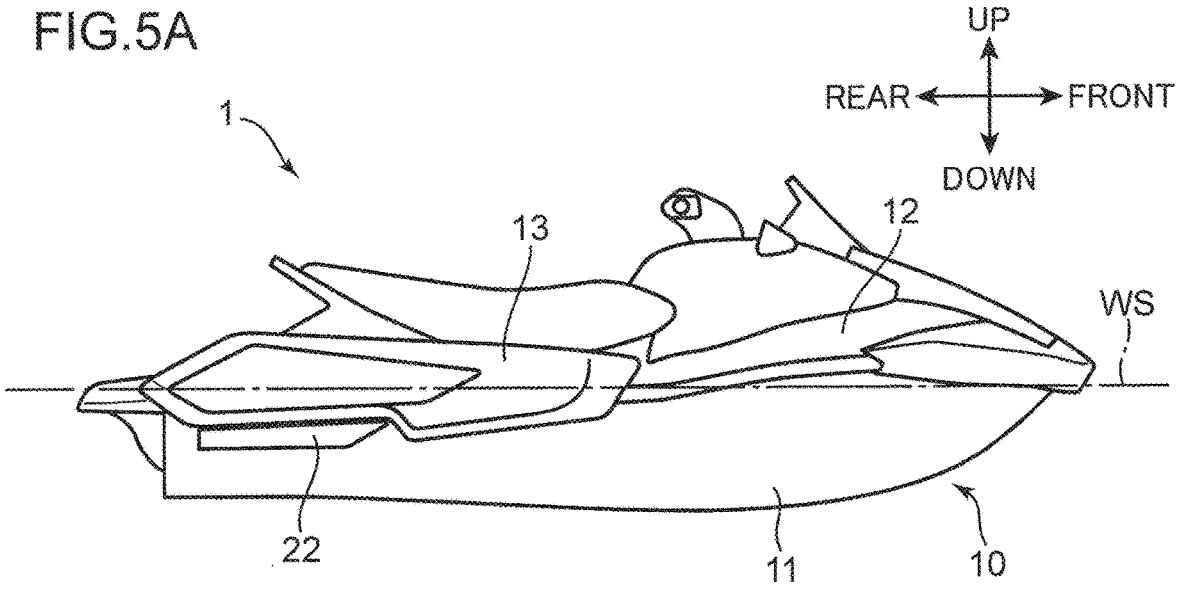
FIG. 5A is a side view illustrating a positional relationship between the personal watercraft during stopping and a water surface.
Figure 5B:
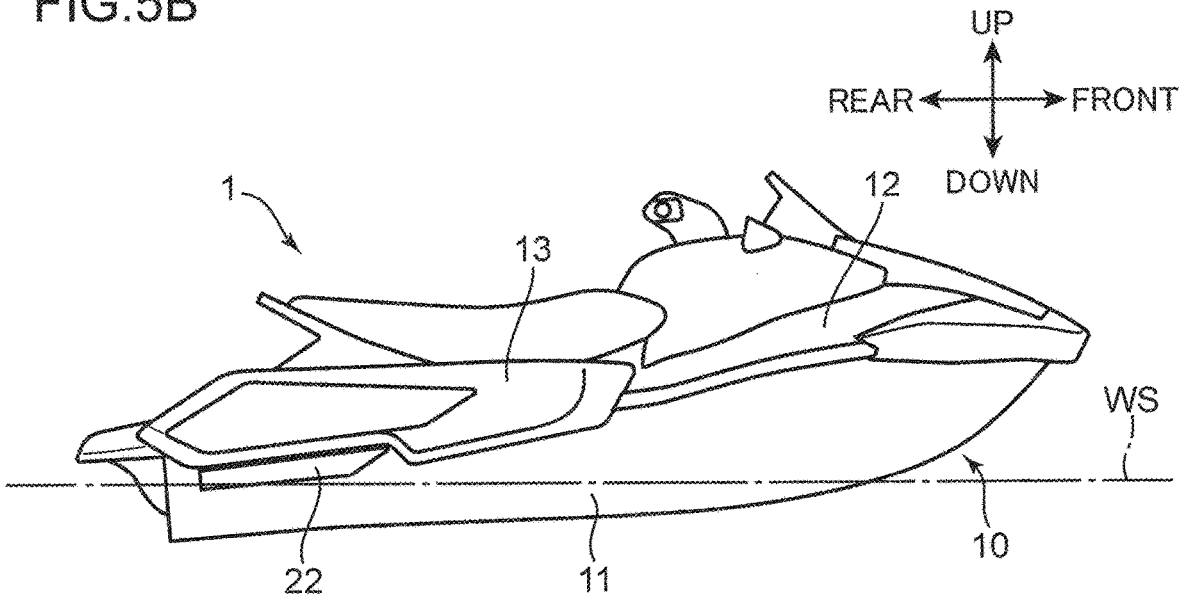
FIG. 5B is a side view illustrating a positional relationship between the personal watercraft during planing and a water surface.

In FIG. 5A, the water surface when the PWC 1 is stopped is represented by sign WS. As illustrated in the figure, the stabilizer 22 is provided at a height where it is submerged when the PWC 1 is stopped, that is, a height lower than the water surface WS. Similarly, the stabilizer 22 submerges also when the moving speed of the PWC 1 is low. On the other hand, as illustrated in FIG. 5B, when the moving speed of the PWC 1 increases and the PWC 1 shifts to the planing state, the stabilizer 22 is exposed upward from the water surface WS. When shifted to the planing state, the PWC 1 moves while planing on the water surface in an inclined attitude such that the bow of the PWC 1 rises. That is, the attitude of the PWC 1 is inclined along with the planing, whereby the stabilizer 22 is exposed upward from the water surface WS.

The pair of stabilizers 22 arranged at the height as described above have an effect of enhancing steering stability when the PWC 1 is turning. That is, during the turning of the PWC 1, only the stabilizer 22 on the turning inner side submerges and paddles, thereby stabilizing the turning operation of the PWC 1.

As illustrated in FIG. 5A, the float 13 is provided at a height where the lower half of the float 13 submerges (becomes lower than the water surface WS) when the PWC 1 is stopped or moving at a low speed. The float 13 partially submerged in this manner exerts a function of additionally giving buoyancy to the watercraft body 10. On the other hand, when the PWC 1 shifts to the planing state, the float 13 is entirely exposed upward from the water surface WS as illustrated in FIG. 5B. This prevents the float 13 from becoming resistance to planing.

As illustrated in FIGS. 1 to 3, a handlebar 15 and a seat 16 are arranged on the deck 12. The seat 16 is a seat on which the driver M who drives the PWC 1 sits. The handlebar 15 is a steering handlebar manipulated by the driver M for steering the PWC 1.

The handlebar 15 is arranged at an upper front part of the deck 12. As illustrated in FIG. 2, the handlebar 15 is provided with an accelerator 23, a start switch 24, and a stop switch 25. The accelerator 23 is a lever for adjusting the moving speed of the PWC 1 by increasing or decreasing the output of the propulsion device 2 (an engine 5 described later). The start switch 24 is a switch for starting the engine 5. The stop switch 25 is a switch for stopping the engine 5. In the present embodiment, the start switch 24 and the stop switch 25 are configured by a common push button switch, and are provided at positions on the handlebar 15 opposite to the accelerator 23 (left side).

The seat 16 extends in the front-rear direction behind the handlebar 15 and is arranged so as to cover the upper surface center of the deck 12. The seat 16 only needs to be a seat on which at least the driver M can sit. That is, the seat 16 may be a seat for a plurality of persons on which not only the driver M but also passengers can sit, or may be a single seat on which only the driver M can sit.

As illustrated in FIGS. 3 and 4, the deck 12 includes a pair of side decks 125 in regions on both left and right sides of the seat 16. The side deck 125 is a plane portion that functions as a footrest for the driver M during maneuvering of the PWC 1, and is formed to extend in the front-rear direction along a side edge (gunwale 14) of the watercraft body 10. An upper surface of the side deck 125 is attached with a deck mat 27 made of a soft material such as rubber.

As illustrated in FIG. 2, the propulsion device 2 includes the engine 5 of an internal combustion type, a jet pump 6 driven by the engine 5 to jet water, and a reverse bucket 7 arranged at an outlet portion of the jet pump 6.

The engine 5 is a power source that generates power for driving the jet pump 6, and includes a water-cooled four-stroke multicylinder engine using gasoline as fuel, for example. The engine 5 is accommodated in an engine room ER formed inside the hull 11. The engine 5 includes a crankshaft 70 extending in the front-rear direction as an output shaft.

The jet pump 6 is a pump that generates a jet water flow jetted rearward from the watercraft body 10. Specifically, the jet pump 6 generates a jet water flow by pressurizing and accelerating water taken into the watercraft body 10, and jets the generated jet water flow rearward from the watercraft body 10. This rear jetting of the jet water flow generates a propulsion force for moving the watercraft body 10 forward.

The jet pump 6 is arranged in the rear part center of the watercraft body 10. The watercraft body 10 has an impeller passage 77 at a position corresponding to the jet pump 6. The impeller passage 77 is a passage having a water intake port 76 formed in the width direction center of a bottom surface 11A of the hull 11 as an inlet, and is formed so as to penetrate the rear part of the hull 11 in the front-rear direction.

The jet pump 6 includes a pump shaft 71, a pump impeller 72, a stator vane 73, a pump case 74, and a jet nozzle 75.

The pump shaft 71 is coaxially coupled to the rear end of the crankshaft 70. The rear part of the pump shaft 71 is inserted into the impeller passage 77. The pump impeller 72 is attached to a rear end part of the pump shaft 71, and thus accommodated inside the impeller passage 77 in a state of being rotatable about the shaft. The driving force of the engine 5 is transmitted to the pump impeller 72 via the crankshaft 70 and the pump shaft 71, and rotates the pump impeller 72 about the shaft. By rotating, the pump impeller 72 generates a jet water flow. The stator vane 73 is attached behind the pump impeller 72, and straightens the jet water flow generated by the pump impeller 72. The pump case 74 is arranged behind the pump impeller 72 and rotatably supports the rear end part of the pump shaft 71.

The jet nozzle 75 is a nozzle having a jet port 79 for jetting a jet water flow generated by the pump impeller 72, and is arranged behind the pump case 74. The jet nozzle 75 has a tapered shape in which the passage cross-sectional area decreases toward the rear. Being supported by the watercraft body 10 via a support shaft extending in the up-down direction, the jet nozzle 75 is swingable left and right.

The jet nozzle 75 is coordinated with the handlebar 15 via a cable or the like so as to swing left and right about the support shaft in accordance with the steering of the handlebar 15. When the jet nozzle 75 is swung by the handlebar 15, the jetting direction of the jet water flow from the jet port 79 is changed to the left and right, thereby changing the traveling direction of the PWC 1.

The rear end part of the impeller passage 77 is a tapered portion 78 in which the passage cross-sectional area decreases toward the rear. A rear part of the tapered portion 78 enters the jet nozzle 75. The water taken into the impeller passage 77 from the water intake port 76 is sent to the tapered portion 78 and the jet nozzle 75 while being pressurized and accelerated in accordance with the rotation of the pump impeller 72, and is jetted at a high speed from the outlet of the jet nozzle 75 having a narrowed passage cross-sectional area, that is, the jet port 79.

The reverse bucket 7 is rotatable in the up-down direction when supported by a component (pump cover) constituting a rear end lower part of the watercraft body 10 via a support shaft extending in the left-right direction. Specifically, the reverse bucket 7 is movable between a forward position illustrated in FIG. 1 in which the reverse bucket 7 is rotated upward so as not to cover the jet port 79 of the jet nozzle 75 and a reverse position in which the reverse bucket 7 is rotated downward so as to cover the jet port 79 of the jet nozzle 75 from the rear. When the reverse bucket 7 is in the forward position (FIG. 2), the PWC 1 moves forward, and when the reverse bucket 7 is in the reverse position, the PWC 1 moves rearward. The deck 12 is provided with a shift lever for switching the reverse bucket 7 between the forward position and the reverse position.

[Details of Float]

Next, a more detailed configuration of the float 13 will be described. As illustrated in FIGS. 1 and 3, the pair of floats 13 are arranged on opposite sides of the seat 16, that is, on the both left and right side parts of the substantially rear half of the watercraft body 10 so as to extend in the front-rear direction along the gunwale 14. A front end part 33 of each of the floats 13 is positioned behind the handlebar 15. In other words, the float 13 extends in the front-rear direction alongside the seat 16 and is arranged limitedly in a region behind the handlebar 15.

In the present embodiment, a front end 16*a* (FIG. 1) of the seat 16 is arranged in substantially the same front-rear position as that of the handlebar 15, and is present in front of the front end part 33 of the float 13. In other words, the float 13 is arranged limitedly in a region behind the front end 16*a* of the seat 16.

As illustrated in FIGS. 1 and 2 and the like, the side surface of the watercraft body 10 has an exposed region AR in front of and near the front end part 33 of the float 13. The exposed region AR is a region where the outer surface of the deck 12 is exposed, and is positioned in front of the float 13 and below the handlebar 15. The covers such as the front cover 18 and the float 13 are arranged to avoid the exposed region AR. The exposed region AR can be used as a display section that displays an identification number of the PWC 1, for example, by a way of engraving or the like.

As illustrated in FIG. 4, the float 13 is a hollow integrally molded product having a closed cross section extending in the front-rear direction. The float 13 has an upper surface 41, an outer side surface 42, and a bottom surface 43. The outer side surface 42 of the float 13 attached to the watercraft body 10 is arranged so as to cover both the hull 11 and the deck 12 from the outside across the gunwale 14. The outer side surface 42 is a surface positioned on the outermost side in the watercraft width direction in the watercraft body 10. The upper surface 41 is formed to extend inward in the watercraft width direction from the upper end of the outer side surface 42 toward the side edge of the deck 12. The bottom surface 43 is formed to extend inward in the watercraft width direction from the lower end of the outer side surface 42 toward the upper part side surface of the hull 11.

The upper surface 41 of the float 13 is formed in a flat shape and is inclined so as to become higher toward an outer side in the watercraft width direction. The upper surface 41 of the float 13 only needs to be a substantially flat surface, and may be a slightly curved surface or may be a surface having fine irregularities. A width dimension W1, which is a dimension in the left-right direction of the upper surface 41 of the float 13, is larger than a width dimension W2 of the gunwale 14.

The upper surface 41 of the float 13 is attached with an upper surface mat 45. The upper surface mat 45 is a sheet-like member made of a material having a friction coefficient larger than that of the float 13, and functions as an antislip member. In the present embodiment, the material of the upper surface mat 45 is a soft material such as rubber, and is the same material as that of the above-descried deck mat 27 attached to the side deck 125.

As mainly illustrated in FIG. 3, the upper surface mat 45 is attached to a region of the upper surface 41 of the float 13 excluding the rear end part thereof. The front end of the upper surface mat 45 is arranged on the front end part 33 of the float 13 at a position slightly behind the front end of the seat 16. The front-rear position of the rear end of the upper surface mat 45 substantially coincides with the front-rear position of the rear end of the seat 16. In other words, the upper surface mat 45 is arranged over the front-rear direction range corresponding to most of the seat 16 including the rear part and the center part of the seat 16. The upper surface mat 45 is arranged in a region of the upper surface 41 of the float 13 close to the outside in the watercraft width direction. This is because the float 13 is arranged to avoid a fastening portion F (upper fastening portion F2) described later.

As illustrated in FIG. 1, the outer side surface 42 of the float 13 is attached with a side surface mat 46. The side surface mat 46 is a sheet-like member made of a material softer than that of the float 13, and functions as a protective member for protecting the float 13. In the present embodiment, the material of the side surface mat 46 is a soft material such as rubber, and is the same material as that of the deck mat 27 and that of the upper surface mat 45 described above. The side surface mat 46 is attached so as to mainly cover a substantially rear half of the outer side surface 42 of the float 13.

Figure 6:
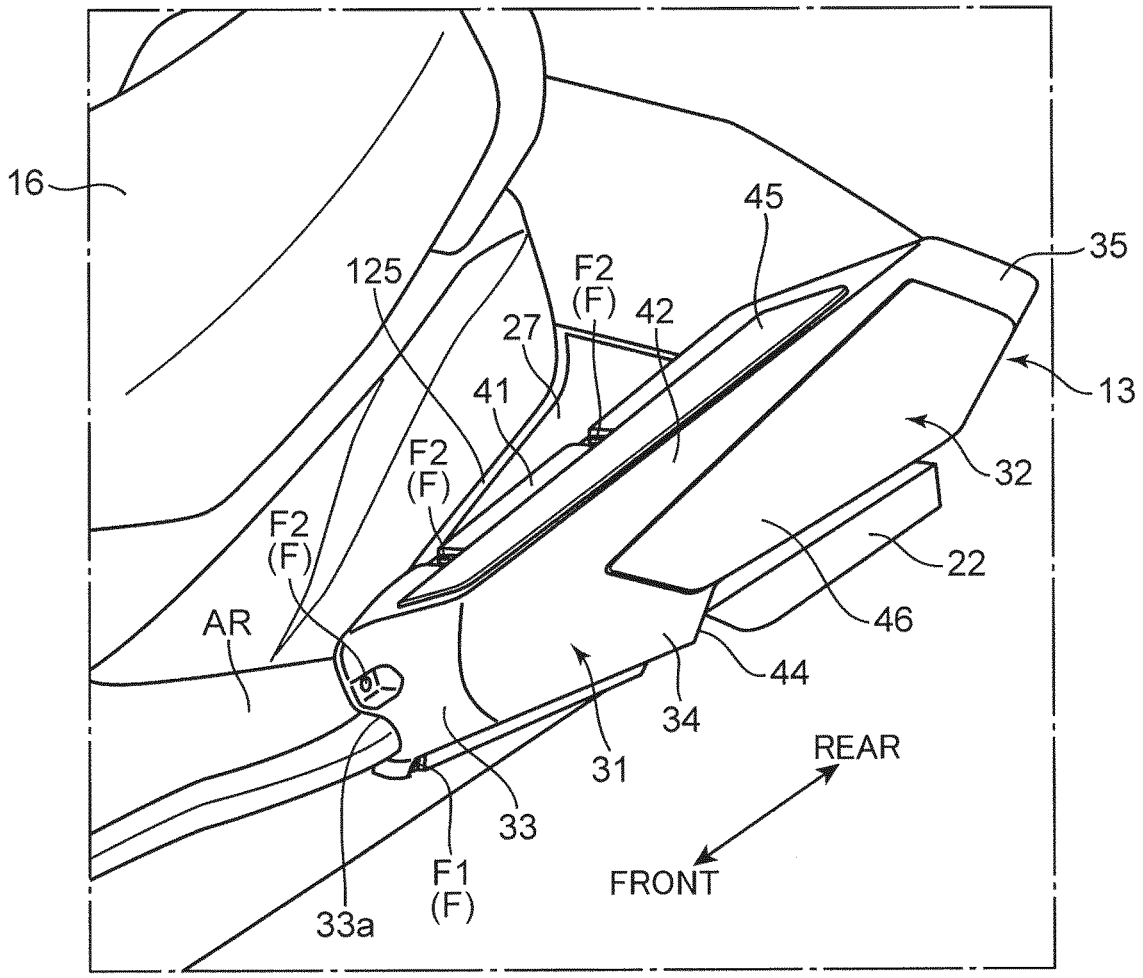
FIG. 6 is a perspective view of a rear part of the personal watercraft as viewed from obliquely upper front.
Figure 7:
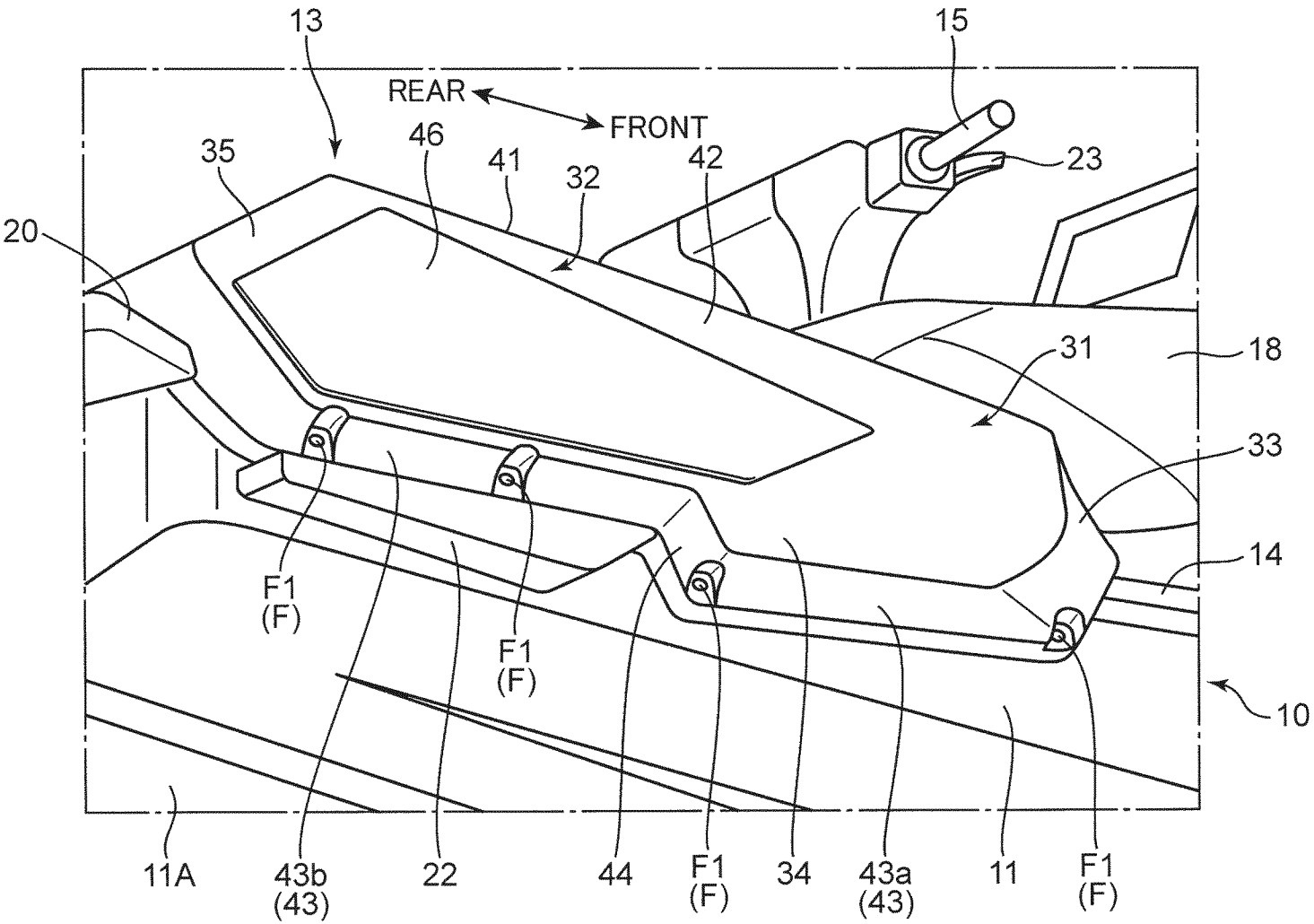
FIG. 7 is a perspective view of the rear part of the personal watercraft as viewed from obliquely lower rear.

FIG. 6 is a perspective view of the rear part of the PWC 1 as viewed from obliquely upper front, and FIG. 7 is a perspective view of the rear part of the PWC 1 as viewed from obliquely lower rear. As illustrated in FIGS. 1, 6, and 7, the float 13 is arranged to extend from a region corresponding to the vicinity of the rear end part of the watercraft body 10 located above the stabilizer 22 to a region corresponding to the vicinity of the center part of the watercraft body 10 located in front of that region. In other words, the float 13 includes a front part 31 positioned in front of the front end of the stabilizer 22 indicated by point P1 in FIG. 1 and a rear part 32 positioned behind the front end (P1) of the stabilizer 22.

The bottom surface 43 of the float 13 includes a front bottom surface 43*a*, which is a bottom surface of the front part 31, and a rear bottom surface 43*b*, which is a bottom surface of the rear part 32. Both the front bottom surface 43*a* and the rear bottom surface 43*b* are formed so as to extend in the front-rear direction while being inclined so as to become higher toward the front side. The rear bottom surface 43*b* extends in the front-rear direction above and near the stabilizer 22 with the same inclination as that of the upper surface of the stabilizer 22. This rear bottom surface 43*b* is positioned higher than the front bottom surface 43*a* on average. The front bottom surface 43*a* and the rear bottom surface 43*b* are continuous with each other via a stepped surface 44. The stepped surface 44 is inclined so as to become lower toward the front side, contrary to the front bottom surface 43*a* and the rear bottom surface 43*b*.

As illustrated in FIG. 1, the lowest position in height in the front part 31 of the float 13 is the rear end of the front bottom surface 43*a* indicated by point P2. Similarly, the lowest position in height in the rear part 32 of the float 13 is the rear end of the rear bottom surface 43*b* indicated by point P3. In the present embodiment, the height of the former is lower than the height of the latter. That is, the front part 31 of the float 13 has a bulging part 34 bulging downward to a position lower than the lower end (P3) of the rear part 32 of the float 13. The bulging part 34 bulges downward in front of the stabilizer 22 and is formed to cover the stabilizer 22 from the front.

The rear side of the point P3 (lowest position) in the rear part 32 of the float 13 is formed such that the vertical dimension decreases rearward. That is, the float 13 has a rear end part 35 extending sharply rearward in side view. The rear end part 35 is arranged so as to cover the gunwale 14 positioned on a side part of the rear end of the watercraft body 10 from the rear and the outside in the watercraft width direction.

As illustrated in FIGS. 3, 6, and the like, the front end part 33 of the float 13 is formed in a tapered shape in which the width dimension (left-right direction dimension) decreases toward the front side. That is, the width dimension of the float 13 becomes the smallest at the frontmost end position of the float 13, and gradually increases from there toward the rear side. The front end part 33 of the float 13 is formed such that the width dimension gradually increases near the frontmost end position in this manner. The width dimension of the float 13 is substantially constant behind the front end part 33.

As illustrated in FIG. 6, a recess portion 33*a* corresponding to the gunwale 14 is formed in the front end part 33 of the float 13. That is, the front end part 33 bulges outward in the watercraft width direction so that a vertical intermediate part thereof avoids the gunwale 14, and a space inside this bulging portion is formed as the recess portion 33*a*. The float 13 is attached to the side part of the watercraft body 10 while receiving the gunwale 14 in the recess portion 33*a* so as to cover the gunwale 14 from the outside in the watercraft width direction. A seal member or the like for preventing water from entering may be arranged between the surface where the recess portion 33*a* is formed and the gunwale 14.

The float 13 is detachably attached to the side part of the watercraft body 10. That is, the float 13 has a plurality of the fastening portions F fastened to the watercraft body 10. The fastening portion F includes a plurality of lower fastening portions F1 (FIGS. 1 and 7) provided on a lower part of the float 13 and a plurality of upper fastening portions F2 (FIGS. 3 and 6) provided in an upper part of the float 13. The lower fastening portion F1 is a fastening portion for coupling the lower part of the float 13 to the hull 11, and the upper fastening portion F2 is a fastening portion for coupling the upper part of the float 13 to the deck 12. The lower fastening portion F1 and the upper fastening portion F2 are separated from each other in the up-down direction. The lower fastening portions F1 are provided at a plurality of positions along the bottom surface 43 of the float 13, and are arranged at appropriate intervals in the front-rear direction. The upper fastening portions F2 are provided at a plurality of positions along the upper surface 41 of the float 13, and are arranged at appropriate intervals in the front-rear direction. In other words, the float 13 is detachably coupled to the side part of the watercraft body 10 via the plurality of fastening portions F dispersed in front, rear, up and down so as to be fastened to a plurality of positions of the hull 11 and a plurality of positions of the deck 12, respectively. The lower fastening portion F1 corresponds to the "first coupling portion" in the present disclosure, and the upper fastening portion F2 corresponds to the "second coupling portion" in the present disclosure.

Figure 8:
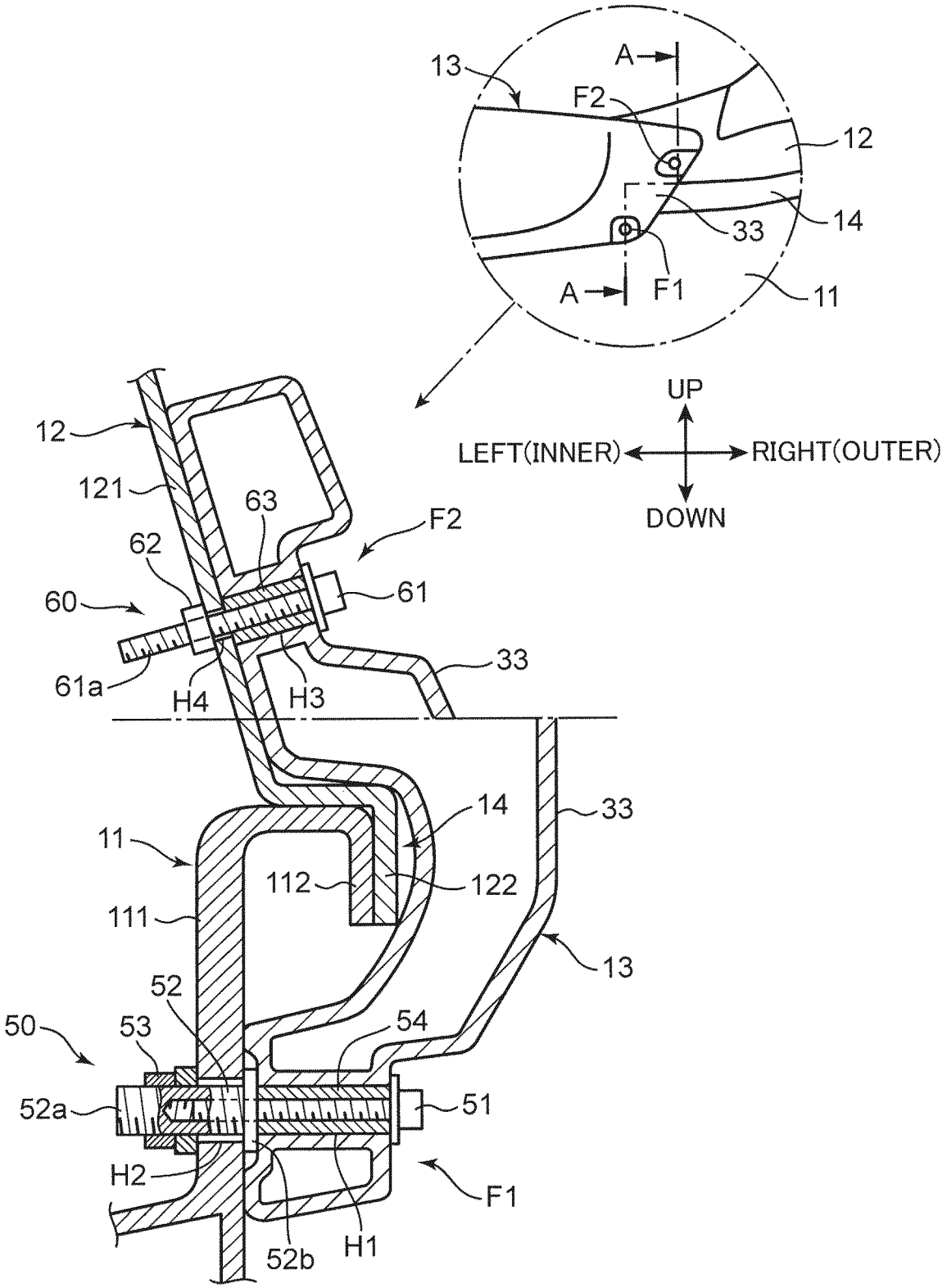
FIG. 8 is a cross-sectional view for illustrating a structure for fastening a float to the watercraft body.

As illustrated in FIGS. 1 and 6, the frontmost lower fastening portion F1 and the frontmost upper fastening portion F2 are both formed at the front end part 33 of the float 13. FIG. 8 is a cross-sectional view taken along line A-A illustrating the structure of the both fastening portions F1 and F2. As illustrated in this figure, the lower fastening portion F1 is coupled to the hull 11 using a fastening member 50 including a bolt 51, a cap nut 52, a nut 53, and a collar 54. The upper fastening portion F2 is coupled to the deck 12 using a fastening member 60 including a bolt 61, a nut 62, and a collar 63.

The structure of the frontmost lower fastening portion F1, that is, the fastening structure of the float 13 using the fastening member 50 (the bolt 51, the cap nut 52, the nut 53, and the collar 54) will be described in detail. A bolt hole H1 (first bolt hole) penetrating the float 13 is formed in a lower part of the front end part 33 of the float 13. A bolt hole H2 (second bolt hole) penetrating the hull 11 is formed at a position corresponding to the bolt hole H1 in the hull 11. The cap nut 52 is inserted into the bolt hole H2 of the hull 11. The cap nut 52 is a tubular nut in which both the outer peripheral surface and the inner peripheral surface are threaded, and includes a tip end part 52*a* that is closed and a base end part that is opened. A flange portion 52*b* is formed at the base end part of the cap nut 52. The cap nut 52 is inserted into the bolt hole H2 from the outside in the watercraft width direction such that the flange portion 52*b* abuts on the outer side surface of the hull 11. In this state, the tip end part 52*a* of the cap nut 52 is arranged so as to enter the inside of the hull 11. When the nut 53 is screwed to this tip end part 52*a*, the cap nut 52 is fixed to the hull 11, and the bolt hole H2 of the hull 11 is scaled by the cap nut 52. In order to seal the bolt hole H2 well, a seal member may be arranged between the flange portion 52*b* of the cap nut 52 and the outer side surface of the hull 11.

The bolt 51 is inserted into the bolt hole H1 from the outside in the watercraft width direction of the float 13. The tip end part of the bolt 51 inserted into the bolt hole H1 is screwed to the inner peripheral surface of the cap nut 52. In this manner, the bolt 51 inserted through the bolt hole H1 of the front end part 33 of the float 13 is screwed into the cap nut 52 fixed to the hull 11, whereby the float 13 is fastened (coupled) to the hull 11.

The collar 54 is inserted between the inner peripheral surface of the bolt hole H1 and the outer peripheral surface of the bolt 51. That is, the collar 54 is a tubular member having an inner diameter capable of receiving the bolt 51 and an outer diameter capable of being inserted into the bolt hole H1. The collar 54 has the same axial length as the bolt hole H1. In other words, the collar 54 is formed to extend from one end to the other end of the bolt hole H1 in a mounted state.

Next, the structure of the frontmost upper fastening portion F2, that is, the fastening structure of the float 13 using the fastening member 60 (the bolt 61, the nut 62, and the collar 63) will be described. A bolt hole H3 penetrating the float 13 is formed in an upper part of the front end part 33 of the float 13. A bolt hole 114 penetrating the deck 12 is formed at a position corresponding to the bolt hole H3 in the deck 12. The bolt 61 is inserted into the bolt hole 113 from the outside in the watercraft width direction of the float 13. The tip end part 61*a* of the bolt 61 inserted into the bolt hole H3 is arranged so as to enter the inside of the deck 12. The nut 62 is screwed to the tip end part 61*a*, whereby the float 13 is fastened (coupled) to the deck 12. The collar 63 has a tubular shape extending over the axial length of the bolt hole H3 and is inserted between the inner peripheral surface of the bolt hole H3 and the outer peripheral surface of the bolt 61.

Although the structures of the lower and upper fastening portions F1 and F2 positioned on the frontmost side have been described above, the lower and upper fastening portions F1 and F2 at other positions are also coupled to the hull 11 and the deck 12 using the similar fastening members 50 and 60.

Operation and Effects

As described above, in the present embodiment, regions behind the handlebar 15 (or the front end 16*a* of the seat 16) on the both left and right side parts of the watercraft body 10 are provided with the pair of floats 13 for additionally giving buoyancy to the watercraft body 10. According to such configuration, there is an advantage that attitude stability can be improved while ensuring planing performance of the PWC 1.

That is, in the present embodiment, since buoyancy is additionally given to the watercraft body 10 from the pair of floats 13 provided on the both left and right sides of the watercraft body 10, as a result of the buoyancy suppressing rolling of the PWC 1, the attitude of the PWC 1 can be stabilized. Therefore, the lateral swing of the PWC 1 can be prevented during stopping of the PWC 1 or during low speed moving, where the moving speed of the PWC 1 is low, and the case of handling of the PWC 1 can be improved.

Figure 9:
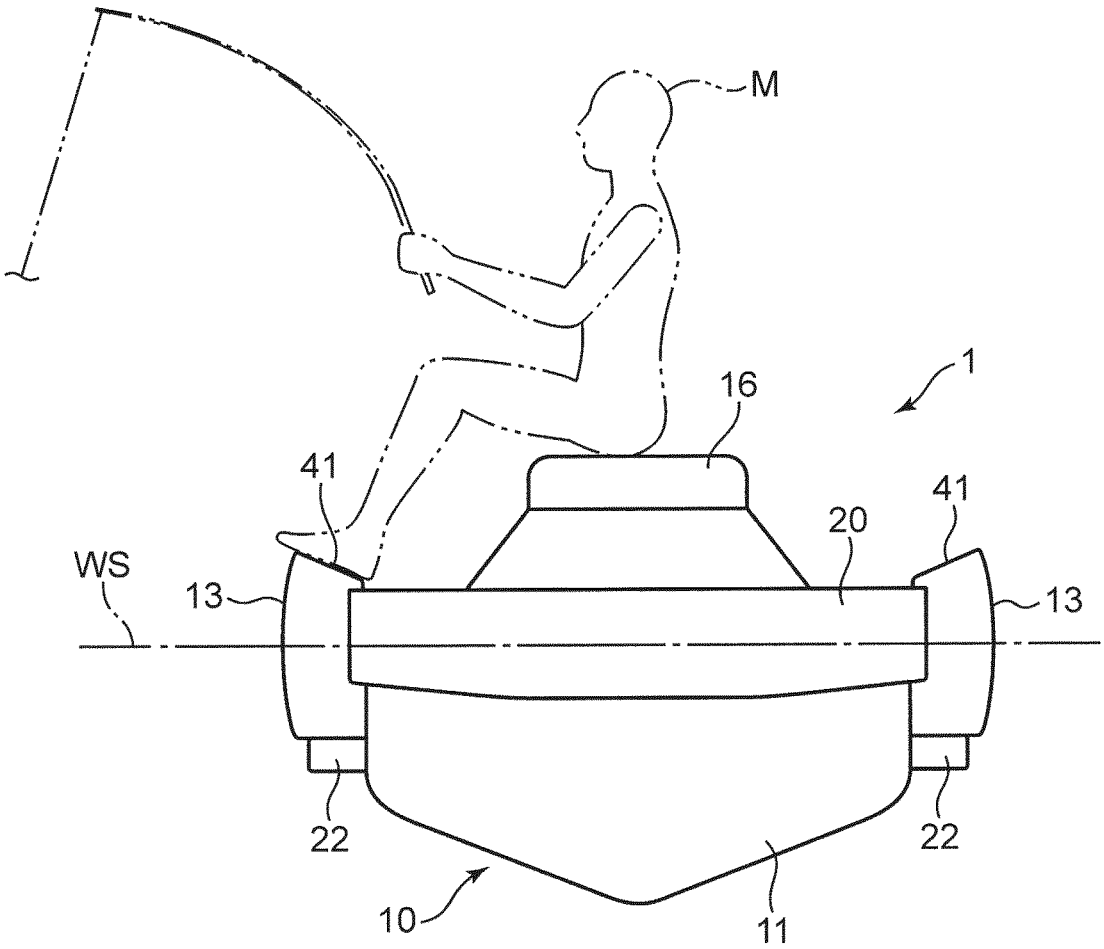
FIG. 9 is a schematic rear view illustrating a scene where an occupant of the personal watercraft is fishing.

The PWC 1 of the present embodiment having excellent attitude stability during low speed moving can be suitably used for applications other than moving on water. As an example, as illustrated in FIG. 9, the PWC 1 can be used for fishing on water. In this case, the driver M performs fishing while seated on the seat 16 of the PWC 1 floating (stopped) on water, for example. At this time, since the lateral swing of the PWC 1 is suppressed by the float 13, the driver M can easily enjoy fishing in an environment with less swing. FIG. 9 exemplifies a case where the driver M is fishing, but in a case where the PWC 1 is a boat for a plurality of persons, passengers other than the driver M can also perform fishing while sitting on the seat 16.

Moreover, in the present embodiment, since the float 13 is arranged limitedly in a region behind the handlebar 15 or the front end 16*a* of the seat 16, it is possible to reduce the extent to which the float 13 obstructs planing during planing of the PWC 1 and to ensure good planing performance of the PWC 1.

In the present embodiment, the lower position of each of the floats 13 is provided with the pair of stabilizers 22 protruding outward in the watercraft width direction from the side surface of the watercraft body 10. According to such configuration, the turning performance of the PWC 1 can be improved by the stabilizer 22, and the function of the stabilizer 22 can be prevented from being impaired by the float 13.

In the present embodiment, the float 13 has the front part 31 positioned in front of the front end of the stabilizer 22 in addition to the rear part 32 positioned behind the front end (P1 in FIG. 1) of the stabilizer 22. According to such configuration, since the length in the front-rear direction of the float 13, in other words, the volume of the float 13 increases, a larger buoyancy can be given to the watercraft body 10.

In the present embodiment, the bulging part 34 bulging downward to a position below the lower end (P3) of the rear part 32 of the float 13 is formed in the front part 31 of the float 13. According to such configuration, the volume of the front part 31 of the float 13 can be increased to give sufficient buoyancy to the watercraft body 10.

In the present embodiment, the upper surface 41 of the float 13 is formed to be substantially flat. According to such configuration, the upper surface 41 of the float 13 can be used as a footrest for occupants including the driver M. For example, when an occupant is fishing while sitting on the seat 16 as illustrated in FIG. 9, the upper surface 41 of the float 13 can be used as a footrest for the occupant.

In the present embodiment, the upper surface 41 of the float 13 is inclined so as to become higher toward the outer side in the watercraft width direction. According to such configuration, the upper surface 41 of the float 13 can be an inclined surface along the angle of the sole of the occupant sitting sideways on the seat 16, and the convenience as a footrest can be enhanced.

In the present embodiment, the width dimension W1 of the upper surface 41 of the float 13 is larger than the width dimension W2 of the gunwale 14, which is the joint portion between the hull 11 and the deck 12. According to such configuration, since the upper surface 41 of the float 13 is formed to be relatively wide, the function of the float 13 as a footrest can be improved.

In the present embodiment, the upper surface mat 45 is attached to the upper surface 41 of the float 13. The upper surface mat 45 has a friction coefficient larger than that of the float 13, and functions as an antislip member that prevents a foot from slipping from the upper surface 41 of the float 13. This can further improve the function of the float 13 as a footrest.

In the present embodiment, the side surface mat 46 is also attached to the outer side surface 42 of the float 13. The side surface mat 46 is made of a material softer than that of the float 13, and functions as a protective member that protects the outer side surface 42 of the float 13. This makes it possible to protect the outer side surface 42 of the float 13 at the time of docking the PWC 1, for example, and to prevent scratches and dents from occurring on the outer side surface 42.

In the present embodiment, the float 13 is detachably attached to the watercraft body 10 via the fastening members 50 and 60. According to such configuration, by selectively attaching the float 13 to the common watercraft body 10, it is possible to produce separately the PWC with the float and the PWC without the float.

In the present embodiment, the float 13 includes the lower fastening portion F1 fastened to the hull 11 via the fastening member 50 and the upper fastening portion F2 fastened to the deck 12 via the fastening member 60. According to such configuration, the float 13 can be coupled to both the hull 11 and the deck 12 constituting the watercraft body 10, and the coupling strength of the float 13 to the watercraft body 10 can be increased.

In the present embodiment, the float 13 is coupled to the hull 11 via the fastening member 50 including the cap nut 52 mounted to seal the bolt hole H2 of the hull 11 and the bolt 51 screwed thereto. According to such configuration, it is possible to prevent water from entering the watercraft body 10 (the hull 11) through the bolt fastening hole, and it is possible to attach the float 13 to the watercraft body 10 while ensuring watertightness.

In the present embodiment, the tubular collar 54 extending over the axial length of the bolt hole H1 is inserted between the outer peripheral surface of the bolt 51 and the inner peripheral surface of the bolt hole H1. According to such configuration, the axial force of the bolt 51 can be received by the collar 54, and deformation in the thickness direction of the float 13 along with fastening of the bolt 51 can be prevented.

In the present embodiment, the front end part 33 of the float 13 is formed such that the width dimension decreases toward the front side. According to such configuration, even if water hits the front end part 33 of the float 13 during moving of the PWC 1, the water can be guided to the outside in the watercraft width direction along the front end part 33 inclined. This can suppress the influence of the float 13 on the planing performance of the PWC 1.

In the present embodiment, the bottom surface 43 of the float 13 is inclined so as to become higher toward the front side. According to such configuration, it is possible to reduce the resistance received by the float 13 during planing, and to ensure the planing performance of the PWC 1 well.

In the present embodiment, the exposed region AR where the outer surface of the deck 12 is exposed is formed in front of the float 13 and below the handlebar 15. According to such configuration, the exposed region AR on the side surface of the watercraft body 10 can be used as a display section that displays an identification number of the watercraft body 10, for example.

Modifications

In the above embodiment, the hollow float 13 internally having a cavity is attached to the side surface of the watercraft body 10, but the float 13 is not limited to a hollow product as long as it has a structure capable of additionally giving buoyancy to the watercraft body 10. For example, a float filled with a foam may be used.

In the above embodiment, the upper surface mat 45 attached to the upper surface 41 of the float 13 and the side surface mat 46 attached to the outer side surface 42 of the float 13 are both made of a soft material such as rubber, but the materials of the mats 45 and 46 may be different from each other. For example, the material of the upper surface mat 45 may be any material having a friction coefficient larger than that of the float 13, and may also be a hard material in which antislip irregularities are formed.

In the above embodiment, the engine 5 of an internal combustion type is used as the power source that generates the propulsion force for moving the watercraft body 10, but the power source is not limited to the engine. For example, an electric motor may be used as a power source, or a hybrid power source in which an electric motor and an engine are combined may be used.

SUMMARY

The above-described embodiment and its modifications include the following disclosure.

A personal watercraft according to one aspect of the present disclosure includes: a watercraft body; a handlebar provided on an upper front part of the watercraft body; a seat provided on an upper part of the watercraft body and extending in a front-rear direction behind the handlebar; and a pair of floats provided so as to protrude outward in a watercraft width direction from left and right side surfaces of the watercraft body in order to additionally give buoyancy to the watercraft body. Each of the floats extends in the front-rear direction alongside the seat and is arranged limitedly in a region behind the handlebar.

According to the present disclosure, since buoyancy is additionally given to the watercraft body from the pair of floats provided on the both left and right sides of the watercraft body, as a result of the buoyancy suppressing rolling of the personal watercraft, the attitude of the personal watercraft can be stabilized. Therefore, the lateral swing of the personal watercraft can be prevented during stopping of the personal watercraft or during low speed moving, where the moving speed of the personal watercraft is low, and the ease of handling of the personal watercraft can be improved.

Since the float is provided limitedly behind the handlebar, it is possible to reduce the extent to which the float obstructs planing during planing of the personal watercraft and to ensure good planing performance of the personal watercraft.

The float may be arranged in a region behind the front end of the seat.

Also in this aspect, it is possible to reduce the extent to which the float obstructs planing.

Preferably, the personal watercraft further includes a pair of stabilizers protruding outward in the watercraft width direction from left and right side surfaces of a rear part of the watercraft body. The floats are arranged above the respective stabilizers.

In this aspect, the turning performance of the personal watercraft can be improved by the stabilizer, and the function of the stabilizer can be prevented from being impaired by the float.

Preferably, the float includes a rear part positioned behind a front end of the stabilizer and a front part positioned in front of the front end of the stabilizer.

Thus, use of the float extending forward beyond the front end of the stabilizer can give a larger buoyancy to the watercraft body.

Preferably, the float has a substantially flat upper surface extending in the front-rear direction.

In this aspect, the upper surface of the float can be used as a footrest for an occupant sitting sideways on the seat.

Preferably, the upper surface of the float is inclined so as to become higher toward an outer side in the watercraft width direction.

In this aspect, the upper surface of the float can be an inclined surface along the angle of the sole of the occupant sitting sideways on the seat, and the convenience as a footrest can be enhanced.

Preferably, the watercraft body includes a hull and a deck joined on the hull, and a width dimension of the upper surface of the float is larger than a width dimension of a gunwale, which is a joint portion between the hull and the deck.

As described above, use of the float having a width dimension larger than that of the gunwale can improve the function of the float as a footrest.

Preferably, the upper surface of the float is attached with an antislip member having a friction coefficient larger than a friction coefficient of the float.

In this aspect, since the foot hardly slides from the upper surface of the float, the function of the float as a footrest can be improved.

Preferably, an outer side surface of the float is attached with a protective member made of a material softer than a material of the float.

In this aspect, the outer side surface of the float can be protected when the personal watercraft is docked, for example.

Preferably, the float is detachably attached to the watercraft body via a fastening member.

In this aspect, it is possible to produce separately the personal watercraft with the float and the personal watercraft without the float.

Preferably, the fastening member includes a bolt inserted into a first bolt hole formed in the float and a cap nut fixed to the watercraft body so as to seal a second bolt hole formed in the watercraft body, and the float is detachably attached to the watercraft body by screwing the bolt to the cap nut.

In this aspect, water can be prevented from entering inside the watercraft body through the bolt holes.

Preferably, the fastening member further includes a collar having a tubular shape capable of receiving the bolt and extending over an axial length of the first bolt hole.

In this aspect, the axial force of the bolt can be received by the collar, and deformation in the thickness direction of the float along with bolt fastening can be prevented.

Preferably, the watercraft body includes a hull and a deck joined on the hull, and the float includes a first coupling portion coupled to the hull and a second coupling portion coupled to the deck.

In this aspect, the float can be coupled to both the hull and the deck constituting the watercraft body, and the coupling strength of the float can be increased.

Preferably, a front end part of the float is formed such that a width dimension decreases toward the front side.

In this aspect, it is possible to suppress the influence of the float on the planing performance of the personal watercraft.

Preferably, a bottom surface of the float is inclined so as to become higher toward the front side.

In this aspect, it is possible to reduce resistance received by the float during planing.

Preferably, a front part of the float includes a bulging part bulging downward to a position below a rear part lower end of the float.

In this aspect, the volume of the front part of the float can be increased to give sufficient buoyancy to the watercraft body.

Preferably, the side surface of the watercraft body has an exposed region in front of the float and below the handlebar.

In this aspect, the exposed region of the side surface of the watercraft body can be used as a display section that displays an identification number of the watercraft body, for example.

The invention claimed is:

1. A personal watercraft comprising:

a watercraft body;

a handlebar provided on an upper front part of the watercraft body;

a seat provided on an upper part of the watercraft body and extending in a front-rear direction behind the handlebar; and a pair of floats provided so as to protrude outward in a watercraft width direction from left and right side surfaces of the watercraft body in order to additionally give buoyancy to the watercraft body, wherein each float extends in the front-rear direction alongside the seat and is arranged only in a region behind the handlebar, the watercraft body includes a hull and a deck joined on the hull, and each float includes a first coupling portion coupled to the hull and a second coupling portion coupled to the deck.

2. The personal watercraft according to claim 1, wherein each float is arranged in a region behind a front end of the seat.

3. A personal watercraft comprising:

a watercraft body;

a handlebar provided on an upper front part of the watercraft body;

a seat provided on an upper part of the watercraft body and extending in a front-rear direction behind the handlebar;

a pair of floats provided so as to protrude outward in a watercraft width direction from left and right side surfaces of the watercraft body in order to additionally give buoyancy to the watercraft body; and a pair of stabilizers protruding outward in the watercraft width direction from left and right side surfaces of a rear part of the watercraft body, wherein the pair of floats extend in the front-rear direction alongside the seat and above the pair of stabilizers, and are arranged only in a region behind the handlebar, and the pair of floats are separated from the pair of stabilizers in an up-down-direction.

4. The personal watercraft according to claim 3, wherein each float includes a rear part positioned behind a front end of the pair of stabilizers and a front part positioned in front of the front end of the pair of stabilizers.

5. The personal watercraft according to claim 1, wherein each float has a substantially flat upper surface extending in the front-rear direction.

6. The personal watercraft according to claim 5, wherein the upper surface of each float is inclined so as to become higher toward an outer side in the watercraft width direction.

7. The personal watercraft according to claim 5, wherein a width dimension of the upper surface of each float is larger than a width dimension of a gunwale, which is a joint portion between the hull and the deck.

8. The personal watercraft according to claim 5, wherein the upper surface of each float is attached with an antislip member having a friction coefficient larger than a friction coefficient of the float.

9. The personal watercraft according to claim 1, wherein an outer side surface of each float is attached with a protective member made of a material softer than a material of the float.

10. The personal watercraft according to claim 1, wherein each float is detachably attached to the watercraft body via a fastening member.

11. The personal watercraft according to claim 10, wherein the fastening member for each float includes a bolt inserted into a first bolt hole formed in the float and a cap nut fixed to the watercraft body so as to seal a second bolt hole formed in the watercraft body, and each float is detachably attached to the watercraft body by screwing the bolt to the cap nut.

12. The personal watercraft according to claim 11, wherein the fastening member for each float further includes a collar having a tubular shape capable of receiving the bolt and extending over an axial length of the first bolt hole.

13. The personal watercraft according to claim 1, wherein a front end part of each float is formed such that a width dimension decreases toward a front side.

14. The personal watercraft according to claim 1, wherein a bottom surface of each float is inclined so as to become higher toward a front side.

15. The personal watercraft according to claim 1, wherein a front part of each float includes a bulging part bulging downward to a position below a rear part lower end of the float.

16. The personal watercraft according to claim 1, wherein the side surfaces of the watercraft body has an exposed region in front of each float and below the handlebar.

17. The personal watercraft according to claim 3, wherein each float is a hollow integrally molded product having a closed cross section extending in the front-rear direction.

18. The personal watercraft according to claim 3, wherein each float is filled with a foam.

* * * * *